United States Patent [19]

Krause, deceased

[11] 3,945,206

[45] Mar. 23, 1976

[54] CONTROL SYSTEM FOR HYDRAULIC PRESSES COMPRISING A PLURALITY OF PRESS RAMS

[75] Inventor: Alfred Walter Joachim Krause, deceased, late of Munich, Germany, by Ilse Krause, heiress

[73] Assignee: Ruthner Industrieanlagen-Aktiengesellschaft, Vienna, Austria

[22] Filed: Mar. 24, 1975

[21] Appl. No.: 561,214

[52] U.S. Cl. ..... 60/374; 60/484; 60/416; 91/170 R; 91/304; 91/411 R

[51] Int. Cl.[2] ..... F15B 3/00; F15B 11/16

[58] Field of Search ..... 60/374, 375, 384, 419, 60/484, 416; 91/170 R, 171, 304, 308, 400, 411 A, 47, 275, 304

[56] References Cited

UNITED STATES PATENTS

| | | | |
|---|---|---|---|
| 1,953,454 | 4/1934 | Wollaeger | 91/275 X |
| 2,329,709 | 9/1943 | Fischer | 91/47 X |
| 2,803,110 | 8/1957 | Chittenden | 91/304 X |

*Primary Examiner*—Edgar W. Geoghegan
*Attorney, Agent, or Firm*—Imirie, Smiley & Linn

[57] ABSTRACT

A control system for hydraulic presses comprising a plurality of press rams, an intensifier having a primary chamber which is connected by a supply conduit to a pump, and a valve which is associated with the primary chamber and when open permits the liquid under pressure to return through a return conduit into a reservoir, the primary chamber being constantly supplied by the pump with high-pressure liquid at a constant rate, and the valve associated with the primary chamber being controlled to move in synchronism with the reciprocating motion of the press rams so that it is closed during the forward stroke and open during the return stroke of the press rams.

5 Claims, 1 Drawing Figure

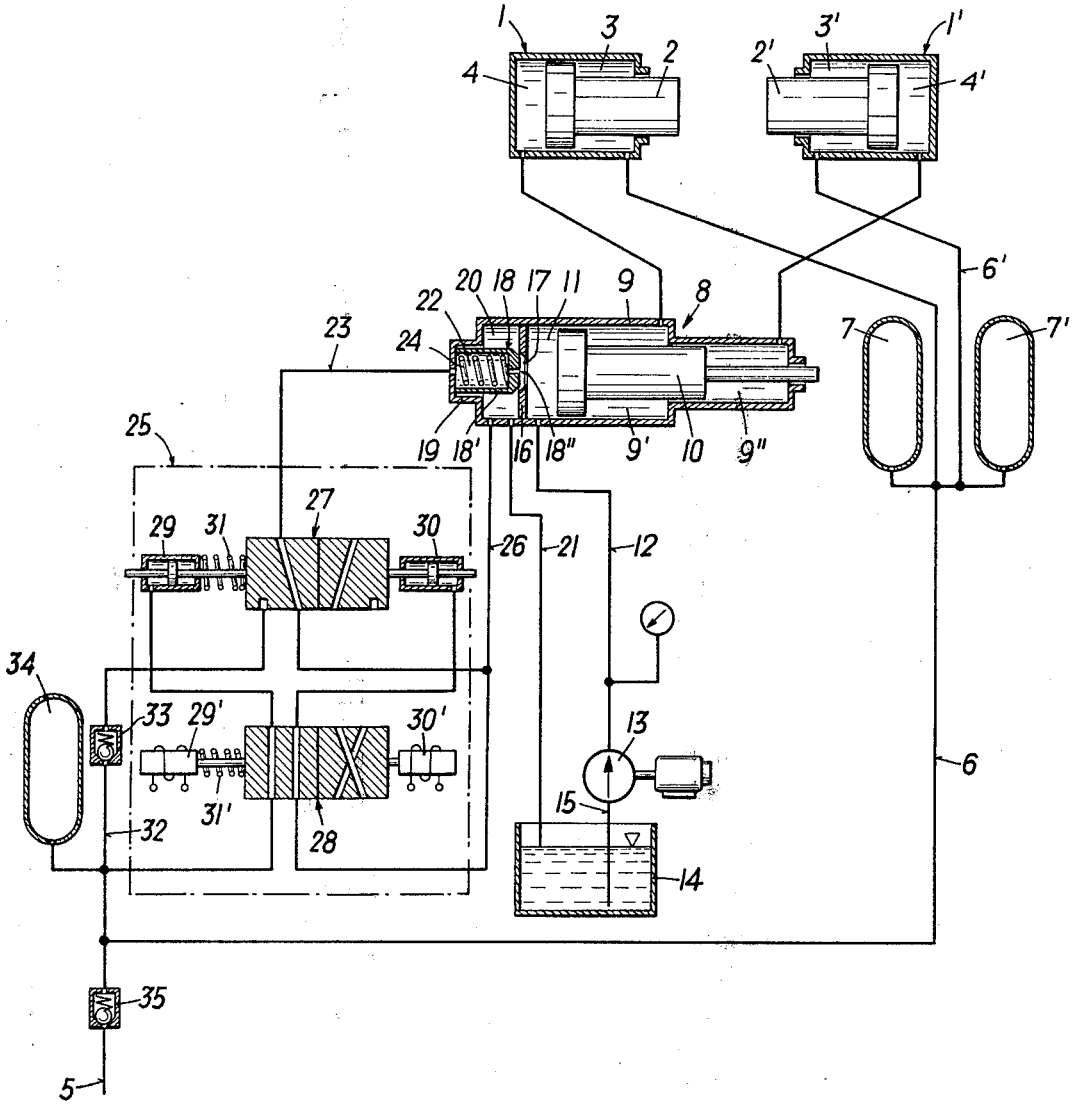
1
3
2
4
2'
3'
1'
4'
6'
20
18
17
11
9
8
22
23
24
7
7'
25
19
18'
16
18"
9'
10
9"
27
29
31
30
26
21
12
34
33
29'
30'
13
6
31'
15
32
28
14
35
5

CONTROL SYSTEM FOR HYDRAULIC PRESSES COMPRISING A PLURALITY OF PRESS RAMS

SUMMARY OF THE INVENTION

A control system for hydraulic presses comprising a plurality of press rams, each of which defines a rear pressure chamber connected to a high-pressure conduit and a forward pressure chamber connected to a low-pressure conduit. The high-pressure conduit includes an intensifier having a piston chamber which at its primary end is constantly supplied with high-pressure liquid and at that primary end is connected in alternation to a return conduit and to the low-pressure conduit by a valve which is controlled to move in synchronism with the press rams.

BACKGROUND OF THE INVENTION

Forging machines are known in which the forging tools must be moved toward each other so that they are always at the same distance from the axis of the workpiece to be forged, particularly when they are at their inner dead center. In such forging machines, a synchronized movement of the rams must be ensured and the distance between the inner dead centers of the forging tools (this distance is also referred to as the final size of the workpiece) and the stroke of the forging tools, i.e., the length of stroke and the stroke position of the press rams, should be adjustable. In a forging machine, the forging tools are reciprocated at high speed so that the number of forging cycles per unit of time is relatively high. It should also be possible to change the stroke frequency.

It is known that this object cannot be accomplished with sufficient accuracy by a control of the hydraulic fluid supplied to the rear end of each ram. On the other hand it is known to provide pump pistons which are associated with respective press rams and which have the same areas and are driven in unison. In such an arrangement, a column of liquid pulsates in the connecting conduit, which is long in most cases, and this column must be controlled. Besides, the stroke frequency can be changed only by a change of the drive speed. When a crank mechanism is used as drive means, the pressure force is not constant throughout the stroke.

It is also known to provide a plurality of positive-displacement pumps, which are associated with respective press rams and in most cases run at high speed. These pumps are driven in unison. Whereas some of the disadvantages mentioned hereinbefore are avoided in such an arrangement, it does not enable a sufficiently precise synchronization because the press rams are supplied with hydraulic fluid at different rates owing to manufacturing tolerances and different oil leakage rates.

It is also known to connect an intensifier between the source of high-pressure liquid and the press rams. This intensifier serves equally to distribute the energy supplied by the source of liquid to a plurality of press rams so that the latter are subjected to equal forces and move equal distances. The intensifier may comprise primary pistons and rigidly coupled secondary pistons. One arrangement of the kind described last comprises an intensifier provided with a valve which is electrically shifted during each stroke and serves to supply the primary chamber with liquid under pressure and enables a return flow of the liquid under pressure.

It is desirable to provide stepped pistons on the secondary side and to attach the primary pistons directly to the secondary pistons because a leakage to the outside will be avoided in that case.

A press ram is associated with each secondary chamber. Particularly in forging machines having oppositely moving, similar press rams the latter will have equal effective piston areas so that the effective piston areas on the secondary side of the intensifier must also be equal if the rams are to move at the same speed.

In this arrangement comprising an intensifier, the source of high-pressure liquid may comprise one pump or a plurality of pumps connected in parallel. Commercially available, high-speed pumps are preferred. The flow rate tolerance of said pump or pumps will not be significant.

If the secondary areas are provided in a number which is equal to the number of press rams and the total secondary area equals the entire primary piston area, the pressure applied to the press rams will equal the pressure applied to the primary side of the intensifier. On the other hand, it is of advantage to increase the pressure. For this purpose, part of the primary piston area is opposite to an area subjected to atmospheric pressure. Where a stepped piston is used, this may be accomplished by the provision of an outwardly extending piston rod. In this case the pressure applied to the press rams will exceed the discharge pressure of the pump. This will not involve any difficulty because the pressure applied to the press rams is not controlled. The intensifier may be disposed closely beside the press ram because particularly if the intensifier comprises stepped pistons there will be no point of leakage along the piston rod or the latter is well sealed at any such point. The connecting conduits leading to the press rams are short just as the columns of pulsating liquid.

In the known arrangements, pulsating pressure is also applied to the primary side and the supply conduits are relatively long because for reasons of safety the source of high-pressure liquid must not be located close to the press owing to the high temperature of the forgings. Whether the pump discharges a pulsating flow or the flow delivered by the pump is pulsed by valve means in the conduit, the relatively long conduits will conduct a pulsating liquid.

It is an object of the invention so to improve the arrangement which has been described hereinbefore that liquid flows at a constant rate in the relatively long conduits between the source of high-pressure liquid and the primary side of the intensifier during an operation in which the press rams move at a predetermined forward speed.

The invention relates to a control system for hydraulic presses comprising a plurality of press rams, an intensifier having a primary chamber which is connected by a supply conduit to a pump, and a valve which is associated with the primary chamber and when open permits the liquid under pressure to return through a return conduit into a reservoir. In such a control system it is a feature of the invention that the primary chamber is constantly supplied by the pump with high-pressure liquid at a constant rate and that the valve associated with the primary chamber is controlled to move in synchronism with the reciprocating motion of the press rams in such a manner that the valve is closed during the forward stroke of the press rams and is open during their return stroke.

Further features of the invention will be explained more fully with reference to the drawing, which is a simplified representation showing by way of example a press comprising two press rams and provided with the control system according to the invention. For the sake of clearness, the scavenging conduits are not shown.

The press comprises two press cylinders 1, 1' and an intensifier 8 connected between said cylinders. Each press cylinder 1, 1' contains a press ram 2 or 2', which in the present case is a stepped piston having a small end which defines a chamber 3 or 3' for low-pressure liquid and a large end defining a chamber 4 or 4' for high-pressure liquid. The press rams 2, 2' are equal in diameter. The chambers 3, 3' are interconnected and are subjected to constant pressure from a low-pressure system. The chambers 3 and 3' are connected to a low-pressure conduit 5 by conduits 6, 6', which incorporate pressure accumulators 7 and 7', respectively, which are disposed near the press cylinders 1, 1'.

The intensifier 8 comprises a stepped cylinder 9 and a stepped piston 10, which is freely slidable in the cylinder 9 and separates the two sections 9', 9'' of the stepped cylinder 9. These sections constitute pressure chambers and are connected to the pressure chambers 4 and 4', respectively. The ratio of the effective cross-sectional areas of the pressure chambers 9', 9'' is the same as the ratio of the effective piston areas of the press rams 2, 2'. It is preferable to provide equal effective piston areas by a selection of proper diameters, as in the present case.

The primary cylinder chamber 11 defined by the large primary end of the stepped piston 10 is connected by a valveless discharge conduit 12 to a pump 13, which on its suction side draws oil through a conduit 15 from a reservoir 14.

The rear wall 16 of the primary chamber 11 has an aperture 17, which forms a valve seat of a shut-off valve 18 comprising a cup-shaped valve member 18'. The latter is guided for approximately one-half of its length by a cylindrical extension 19 of the cylinder 9 of the intensifier 8.

The valve member 18' extends through an auxiliary chamber 20, which is connected by an oil return conduit 21 to the reservoir 14, which is under atmospheric pressure. The interior 22 of the valve member 18' is connected to a control conduit 23.

To prevent the high pressure in the primary chamber 11 of the intensifier from forcing open the simple shut-off valve 18 which is shown, the valve member 18' is formed in its bottom with a constricted passage 18'', which permanently communicates with the primary chamber 11. A spring 24 tends to close the shut-off valve 18.

The shut-off valve 18, more particularly its valve member 18'', is controlled by a control valve 25 having a valve member which connects the conduit 23 selectively to a conduit 26, which opens into the auxiliary chamber 20, or to a connecting conduit 32 leading to the low-pressure conduit 5.

The valve member of the control valve 27 is shifted to one or the other of its end positions by control pistons 29 and 30, which are controlled by a solenoid-controlled pilot valve 28. The latter is pulse-controlled in response to the operation of the press rams 2, 2'. A spring 31 is provided, which in case of trouble moves the valve member of the control valve 27 to the position shown or holds it in said position. In that position, as will be described more fully hereinafter, the shut-off valve 18 is held open and oil under pressure can flow from the primary chamber 11 into a reservoir, in the present case the oil reservoir 14.

The system also comprises a check valve 33 and a pressure accumulator 34 in the connecting conduit 32 and a check valve 35 in the low-pressure conduit 5.

It will be understood that auxiliary means such as accumulator pressure valves, means for preventing overpressure, and the like are not described in connection with the present system.

The control system which has been described has the following mode of operation:

Liquid under pressure is constantly delivered by the pump 13 to the primary chamber 11 of the intensifier 8. Constant pressure is applied from the low-pressure system to the chambers 3, 3'. In the position shown, the control valve 27 connects the chamber 22 via conduit 23 and the auxiliary chamber 20 to the atmosphere. The force of the spring 24 is selected so that the pressure in the primary chamber 11 holds the valve open when the control valve 27 is in this position so that the liquid under pressure can then flow through the auxiliary chamber 20 into the reservoir 14. To initiate the press operation, the control valve 27 is shifted to the left in the drawing by the pilot valve 28.

In the resulting position, the control valve 27 connects the chamber 22 to the low-pressure conduit 5 so that the pressure in the latter and the force of the spring 24 cooperate to hold the valve 18 closed against the action of the pressure in the primary chamber 11.

If the primary pressure in the intensifier 8 exceeds the control pressure applied to the valve 18, the high pressure will also be effective on the other side of the valve member 18' so that the check valve 33 in the conduit 32 closes and an equalization of pressure results. The valve 18 remains closed with a contact pressure which is due to the different sealing areas with respect to the auxiliary chamber 20 and the action of the additional spring 24.

When the valve 18 is closed, the pistons 10 and the press rams 2, 2' are moved in the forward direction.

When the forward stroke has been completed, the pilot valve 28 causes the control valve 27 to assume the position which is shown on the drawing and in which the chamber 22 is connected by the conduit 23 to the oil reservoir 14 so that the force tending to close the valve 18 is reduced by the pressure in conduit 5. As a result, the valve 18 is opened under the action of the pressure in the primary chamber 11.

When the valve 18 is open, the constant pressure applied from conduit 5 via the forward chambers 3, 3' to the press rams 2, 2' forces the latter and the piston 10 of the intensifier 8 in the opposite direction toward their initial position. The liquid which is thus displaced and the liquid discharged by the pump 13 flow through the valve 18.

Whereas the pump discharges at a constant flow rate, its discharge pressure at any given time of the forging cycle is only as high as is actually required at that time. During the idle forward movement performed before the tools contact the workpiece, it is sufficient to overcome the pressure in the chambers 3, 3'. The pump 13 discharges against zero backpressure during the return stroke. As a result, the energy consumption is minimized.

The reversal in the end position is controlled by known suitable means of mechanical, electric, electronic or photoelectric type in response to the position of the press rams. The length of stroke and the stroke position can be controlled in this manner.

According to the invention the forward speed of the piston 10 of the intensifier 8 and of the press rams 2, 2' can be changed by a change of the flow rate at which the high-pressure liquid is delivered from its source. During an operation with a given length of stroke, the return speed will determine the number of forging cycles per unit of time. Various means are known for changing the discharge rate of a pump.

Slight leakages of oil at different rates may result in different stroke positions of the press rams after a plurality of strokes. According to the invention the pressure chambers between the intensifier pistons and press rams are scavenged when this condition has been detected by suitable sensing and indicating means, or said pressure chambers may be automatically scavenged after a predetermined number of strokes. For this scavenging operation the shut-off valve is opened and all pistons are moved toward their rear end position. Liquid under pressure is then forced through valves into the pressure chambers on one side, e.g., the secondary pressure chambers defined by the stepped piston 10, and is drained, e.g., through controlled check valves, from the other side, e.g., from the pressure chambers 4, 4' defined by the press rams 2, 2'. During this operation all pistons and rams return until they engage inner stops so that the press rams are again in the same relative position. The scavenging operation also causes fresh oil to replace the oil which has been heated as a result of the pulsating pressure in the closed pressure chambers.

An important feature of the invention is the design of the controlled shut-off valve 18 because it must conduct large quantities of liquid within a short time. For this reason it is a feature of the invention to insert this valve directly in the wall of the primary chamber 11 of the intensifier 8.

Because it is not desirable to use liquid under the high pressure produced by the pump 13 for auxiliary operations, such as the return of the press ram, the control of the shut-off valve, and scavenging, it is a feature of the invention to use for these purposes a liquid which is under a lower pressure and supplied from a separate pressure system.

What is claimed is:

1. A control system for hydraulic presses comprising a plurality of press rams, which are movable in a forward direction toward each other and in a rearward direction away from each other in alternation, comprising a high-pressure conduit and a low-pressure conduit, said high-pressure conduit incorporating an intensifier and communicating with first chambers, which are associated with respective press rams and adapted to apply pressure to said press rams so as to urge them in said forward direction, said low-pressure conduit communicating with second chambers, which are associated with respective press rams and adapted to apply pressure to said press rams so as to urge them in said rearward direction, said intensifier comprising a piston which is displaceable in a housing under the action of the pressure fluid in the high-pressure conduit and which defines in said housing a primary chamber and at least one secondary chamber, said primary chamber being constantly supplied with high-pressure liquid from said high-pressure conduit throughout the operation of the press, said secondary chamber communicating with said first chambers associated with said press rams, said primary chamber being connected by a first valve to a control conduit, and a second valve being provided, which is adapted to connect said control conduit in alternation to said low-pressure conduit and a return conduit in synchronism with the reciprocating motion of said press rams.

2. A control system as set forth in claim 1, in which said primary chamber has a wall opening which is adapted to be closed by said first valve and said first valve is disposed in an auxiliary chamber connected between said primary chamber and said control conduit leading to said second valve.

3. A control system as set forth in claim 2, in which said first valve comprises a cylindrical member which is open at one end and guided in a cylindrical extension of said auxiliary chamber, and said control conduit leading to said second valve is connected to said extension.

4. A control system as set forth in claim 2, in which said first valve has a bottom formed with a constricted passage through which said primary chamber communicates with said control conduit.

5. A control system as set forth in claim 1, in which said control conduit is connected by a check valve to said low-pressure conduit.

* * * * *